US005507146A

United States Patent [19]

Bjerklie

[11] Patent Number: 5,507,146

[45] Date of Patent: Apr. 16, 1996

[54] METHOD AND APPARATUS FOR CONDENSING FUGITIVE METHANE VAPORS

[75] Inventor: John W. Bjerklie, Upper St. Clair, Pa.

[73] Assignee: Consolidated Natural Gas Service Company, Inc., Pittsburgh, Pa.

[21] Appl. No.: 322,080

[22] Filed: Oct. 12, 1994

[51] Int. Cl.[6] ..... F25J 1/00

[52] U.S. Cl. ..... 62/10; 62/54.3; 62/320

[58] Field of Search ..... 62/54.1, 54.2, 62/54.3, 10, 9, 8, 320

[56] References Cited

U.S. PATENT DOCUMENTS

| | | | |
|---|---|---|---|
| 1,680,873 | 8/1928 | Lucas-Girardville | 62/54.3 |
| 3,521,457 | 7/1970 | Hemstreet | 62/45 |
| 3,521,458 | 7/1970 | Huibers et al. | 62/45 |
| 3,545,226 | 12/1970 | Newell | 62/54.3 |
| 3,745,785 | 7/1973 | Crawford | 62/54.2 |
| 3,800,550 | 4/1974 | Delahunty | 62/54 |
| 3,834,174 | 9/1974 | Strumbos | 62/54.3 |
| 3,857,251 | 12/1974 | Alleaume | 62/28 |
| 3,864,927 | 2/1975 | Li | 62/54.3 |
| 3,919,852 | 11/1975 | Jones | 62/7 |
| 3,994,141 | 11/1976 | Schrawer | 62/76 |
| 4,010,779 | 3/1977 | Pollock et al. | 141/44 |
| 4,017,283 | 4/1977 | Witt | 62/40 |
| 4,068,710 | 1/1978 | Edwards | 165/111 |
| 4,187,689 | 2/1980 | Selcukoglu et al. | 62/54 |
| 4,211,085 | 7/1980 | Tyree, Jr. | 62/48 |
| 4,224,801 | 9/1980 | Tyree, Jr. | 62/48 |
| 4,292,062 | 9/1981 | Dinulescu et al. | 62/7 |
| 4,320,627 | 3/1982 | Hvizdos | 62/54 |
| 4,507,941 | 4/1985 | Lester et al. | 62/54.2 |
| 4,675,037 | 6/1987 | Newton | 62/28 |
| 4,693,737 | 9/1987 | Tyree, Jr. | 62/10 |
| 4,727,723 | 3/1988 | Durr | 62/54 |
| 4,846,862 | 7/1989 | Cook | 62/9 |
| 5,220,801 | 6/1993 | Butler et al. | 62/54.1 |

FOREIGN PATENT DOCUMENTS

| | | | |
|---|---|---|---|
| 0242141 | 4/1969 | U.S.S.R. | 62/54.3 |

*Primary Examiner*—Ronald C. Capossela
*Attorney, Agent, or Firm*—Pearne, Gordon, McCoy & Granger

[57] ABSTRACT

Fugitive methane or natural gas vapors are recovered from a handling or delivery system and are blown through solid methane chips or a slush of solid and liquid methane. The solid methane melts and cools the vapors below the vaporization temperature to condense them. The condensed vapors and melted solid can be mixed with liquid methane for use therewith. The solid methane is produced by cooling liquid methane or natural gas in a liquid nitrogen heat exchanger or refrigerator. The liquid methane is solidified in a sheet on an endless belt, which breaks the sheet into pieces at a tail section.

14 Claims, 1 Drawing Sheet

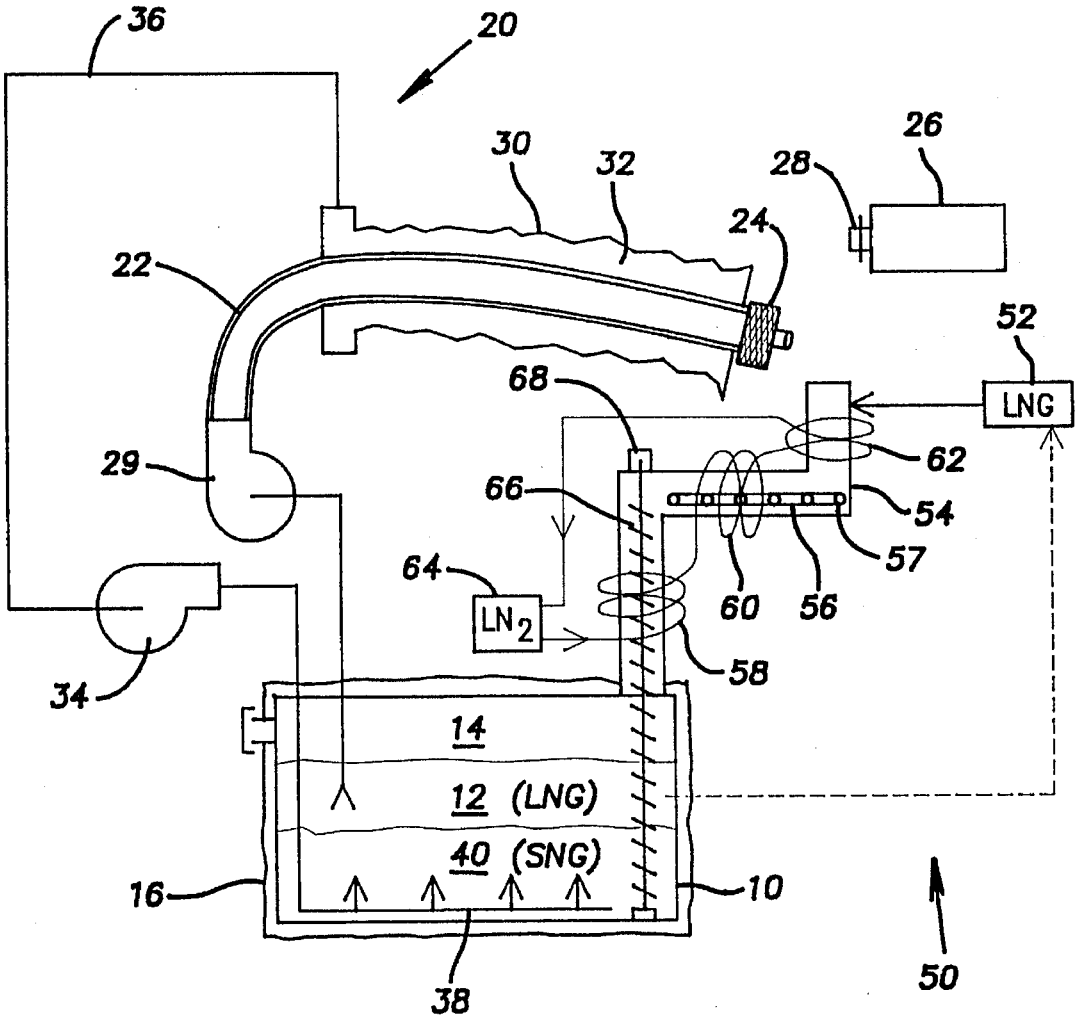
36
20
30
32
26
28
24
22
52
LNG
68
62
29
66
54
57
64
60
56
LN2
58
34
14
12 (LNG)
40 (SNG)
16
10
38
50

METHOD AND APPARATUS FOR CONDENSING FUGITIVE METHANE VAPORS

BACKGROUND OF THE INVENTION

1. Field of the Invention

This invention relates generally to the field of natural gas storage and handling and specifically to a natural gas vapor condensing system.

2. Description of the Related Art

As more stringent emissions standards are established for motor vehicles, the use of alternatives to gasoline and diesel fuels becomes increasingly desirable. Among the alternatives is natural gas, comprising primarily methane, which can be used in most internal combustion engines, often with minimal modification. Methane has also been used to some extent as a fuel for aircraft. Because the normal state of natural gas is gaseous, certain storage, delivery, and handling considerations arise. Compressed natural gas has been used with some success, but does not provide nearly the same energy density as gasoline. Liquified natural gas (LNG) provides greater energy density, but must be insulated and is ordinarily slightly pressurized. LNG held in storage tanks, located on ships or on land, is subject to evaporation due to heat leakage through insulation of the tanks. LNG handling and delivery systems for transferring LNG from one vessel to another are well known, but during transfer, some of the LNG evaporates and can be lost to the atmosphere. For example, during delivery from a bulk storage tank to a natural gas fueled vehicle tank or other small vessel, vapors are generated and may be lost and liquids may be spilled. Natural gas in the vehicle tank may also evaporate and be wasted. In any storage or transfer system, waste and spillage should be minimized due to efficiency and environmental factors.

Natural gas comprises primarily methane with various amounts of other components. The present description discusses the use of methane, but would apply to natural gas or any other substance including a significant amount of methane. "Fugitive" methane includes methane or natural gas that does not reach or is unusable at the intended destination, such as the vessels or tanks discussed above, and can be recovered or contained in a vaporous or liquid state. The fugitive methane may be vapors that are not efficiently delivered or result from spills or evaporation. It is desirable to recover the fugitive methane, which would otherwise be wasted. Fugitive vapors can be recovered by any of a number of known means. Once these vapors are recovered, it is desirable to return them to the supply of LNG for storage or use.

U.S. Pat. No. 4,846,862 to Cook, incorporated herein by reference, shows a system that uses a closed-loop nitrogen refrigeration cycle to reliquify LNG boil-off from a storage receptacle.

It is desirable to have a method and system that reliquifies or condenses natural gas or methane vapors by thermal contact with a sufficiently cold substance. In addition, the method should not introduce undesirable impurities into the natural gas.

SUMMARY OF THE INVENTION

The present invention provides a method of condensing fugitive methane including the steps of providing solid methane; and passing the fugitive methane in heat exchange relationship with the solid methane so as to condense the fugitive methane. The solid methane is melted during heat exchange with the fugitive methane and forms a slush. The step of passing the fugitive methane in heat exchange relationship with the solid methane includes forcing the fugitive methane through interstices of the solid methane.

Additional steps include delivering liquid methane from a first vessel to a second vessel; recovering fugitive methane generated in the step of delivering the liquid methane; and returning the condensed fugitive methane to the first vessel. The step of providing solid methane includes manufacturing the solid methane from liquid methane in the first vessel. The solid methane is provided at a temperature near its melting temperature so as not to condense selected diluents of the fugitive methane.

The method also includes the step of manufacturing the solid methane. The solid methane is manufactured proximate to where the fugitive methane is being condensed. The step of manufacturing the solid methane includes providing liquid methane; cooling the liquid methane so as to form a sheet of solid methane; and breaking the sheet into pieces. The sheet is formed on a moving endless belt and the sheet is broken at a bend in the belt. The step of cooling the liquid methane includes cooling with a refrigeration system using liquid nitrogen as a refrigerant.

The invention also provides an apparatus for condensing fugitive methane. A first vessel is provided for containing liquid methane and solid methane. A delivery conduit is provided for conveying liquid methane from the first vessel to a second vessel. A recovery apparatus is provided for recovering fugitive methane vapors produced from evaporation of liquid methane. A recovery conduit is provided for transferring the fugitive methane vapors from the recovery apparatus to the first vessel. A device in communication with the recovery conduit is arranged to convey the fugitive methane vapors into thermal communication with the solid methane, said fugitive methane vapors being condensed by a transfer of heat to the solid methane.

The solid methane is mixed with liquid methane and forms a slush. The device includes a sparger in communication with the recovery conduit and located in the first vessel so as to convey the recovered fugitive methane vapors through interstices of solid methane in the first vessel, said methane vapors being condensed by the solid methane.

A solid methane manufacturing system is provided for manufacturing and conveying solid methane to the first vessel. The solid methane manufacturing system comprises a supply conduit in communication with the first vessel and connectable to a source of fluid methane. A cooler in heat exchange relationship with the supply conduit is adapted to solidify fluid methane from the source, said solidified methane being conveyed to the first vessel by the supply conduit. The source of fluid methane can be the first vessel. The cooler includes a cooling coil circulating coolant. A surface is disposed in the supply conduit on which a sheet of solid methane can be formed. Means for breaking the sheet of solid methane is provided.

The supply conduit of the solid methane manufacturing system comprises an upper, middle, and lower sections in communication with the first vessel and connectable to a source of liquid methane. The surface is an endless belt disposed in the supply conduit. The cooling coil is in counterflow, heat exchange relationship with the supply conduit and circulates a coolant. The cooling coil has a subcooling section at the lower section, a cooling section at the middle section, and a precooling section at the upper section, so as to solidify liquid methane from the source on the belt. An auger is disposed in the lower section of the supply conduit for conveying said solidified methane from the belt to the first vessel. The endless belt is adapted to break the sheet into pieces and the auger is adapted to convey such pieces.

According to the invention, methane or natural gas is effectively recovered and recycled, thereby reducing waste and undesirable emissions. The recycled methane is free from contaminants. Air or other diluents with the methane will ordinarily not be condensed and can easily be separated. Carbon dioxide will solidify for simple removal.

BRIEF DESCRIPTION OF THE DRAWING

The figure shows a schematic diagram of a fugitive methane recovery and condensing system according to the invention.

DESCRIPTION OF THE PREFERRED EMBODIMENTS

Referring to the figure, an installation embodying the invention includes a first vessel 10, such as a storage tank, that contains liquid methane, typically as a primary component of liquid natural gas (LNG) 12. Ullage 14, including, for example, vaporous natural gas, is disposed above the LNG 12. The vessel 10 is provided with cryogenic insulation 16 to maintain the contents of the vessel at a suitable cryogenic temperature.

A liquid methane delivery and recovery system 20 includes a delivery conduit 22 in communication with the first vessel 10 and provided with a fitting 24. A second vessel 26, generally smaller than the first, such as a tank on a vehicle, is provided with a port 28 adapted to mate with the fitting 24. The fitting 24 may be adapted to open and close a valve included therein or on the port upon coupling or decoupling, respectively. Alternatively, a valve may be provide in the delivery conduit 22. The delivery conduit is in communication with the LNG 12 through a delivery pump 29 so as to permit filling of the second vessel 26 with LNG.

A recovery sheath 30 surrounds the delivery conduit 22 so as to create a passage 32 therebetween. The passage 32 communicates with an inlet of a pump 34 through a recovery conduit 36. An outlet of the pump 34 communicates with a sparger 38 disposed in the first vessel 10. Cryogenic insulation (not shown) is preferably provided on all parts of the delivery and recovery system 20.

According to one embodiment of the invention, solid methane or solid natural gas (SNG) 40 is provided in the vessel 10 as chips, flakes, or other suitable form entirely as a solid or mixed with liquid methane to form a slush. The sparger 38 is located in the vessel 10 so as to be substantially covered by the SNG 40. The sparger 38 forces the fugitive methane through interstices of the solid methane and heat exchange between the fugitive methane gas and the surfaces of the SNG occurs. Other devices adapted to pass the fugitive methane in heat exchange relationship or thermal communication with the solid methane or slush would be suitable.

In operation, the fitting 24 is secured to the port 28 of the second vessel 26. The sheath is positioned around the fitting 24 so as to enclose and isolate the fitting from its surrounding environment and can place the passage in communication with ullage of the second vessel 26. The sheath may be secured or sealed around the fitting by suitable means. The recovery pump 34 is activated to create a reduced pressure inside the sheath 30. Subsequently, the delivery pump 29 is activated to transfer LNG 12 from the first vessel 10 to the second vessel 26 through the delivery conduit 22. During delivery, some of the LNG being transferred to or previously contained in the second vessel 26 may be spilled or vaporized, thereby becoming fugitive methane or natural gas. The fugitive methane is drawn into the passage 32 by the reduced pressure inside the sheath 30. The fugitive methane is transferred to the sparger 38 through the recovery conduit 36 and recovery pump 34.

In the vessel 10, the fugitive methane passes in heat exchange relationship with the SNG 40. In the embodiment shown, the fugitive methane is forced or blown through the interstices of the SNG 40. As the fugitive methane passes through the SNG 40 heat is transferred from the gaseous fugitive methane to the SNG, thereby melting some of the SNG and condensing the fugitive gasses. Alternatively, the delivery and recovery system 20 can be an add-on apparatus including, for example, a separate tank or heat exchanger for condensing the fugitive methane vapors.

The amount of SNG required to condense all of the fugitive methane gas will depend on several factors including the relative quantities of the fugitive gas components (including diluents, such as air) and the total mass and temperature of the fugitive gas.

Assuming for simplicity that pure solid methane is used to liquify pure gaseous methane at room temperature, the amount of solid methane at its melting temperature required to liquify 1 kg of gaseous methane is determined by the following relationship:

$$m_{sm}\ (H_f+C_{lm}\ \Delta T_{lm})=1\ kg\ (H_v+C_{fm}\ \Delta T_{fm})$$

where, $m_{sm}$=mass of solid methane $H_f$=heat of fusion of methane (14.5 cal/g)

$C_{lm}$=mean specific heat (heat-capacity) of liquid methane (0.83 cal/gK)

$\Delta T_{lm}$=change in temperature of liquid methane from boiling point (109.15K) to melting point (90.67K)

$H_v$=heat of vaporization of methane (138.0 cal/g)

$C_{fm}$=mean specific heat (heat capacity) of vaporous fugitive methane (0.49 cal/gK) $\Delta T_{fm}$=change in temperature of fugitive methane from room temperature (293K) to boiling point (109.15K)

Substituting and assuming completely efficient heat transfer:

$$m_{sm}\ kg\ (14.5\ cal/g+0.83\ cal/gK\ (109.15K-90.67K))=1\ kg\ (138.0\ cal/g+0.49\ cal/gK\ (293K-109.15K))$$

Thus, approximately 7.6 kilograms of solid methane must be melted and warmed to the boiling point to liquify 1 kilogram of gaseous methane from room temperature. At a density of 0.718 kg/m$^3$, 1.39 m$^3$ of gaseous methane can be liquified by the 7.6 kg of solid methane. The solid natural gas 40 may be provided to the first vessel 10 from any convenient source.

The present invention also provides a solid natural gas manufacturing system 50 for manufacturing the SNG proximate to where the fugitive methane is condensed. An LNG supply 52 obtains LNG or other fluid methane from the first vessel 10 or an independent source. The LNG is transferred to a supply conduit 54. A conveyor, such as a horizontally disposed endless belt 56, is disposed in the supply conduit 54. The endless belt 56 is supported on rollers 57 and driven by a motor (not shown).

The supply conduit has upper, middle, and lower sections adapted to be cooled by a suitable cooling apparatus, such as a refrigeration system. Cooling coils surround the supply conduit in heat exchange relationship, including a subcooler section 58, a cooler section 60, and a precooler section 62. Liquid nitrogen flows through the coils 58, 60, 62 from a supply system 64. The cooling apparatus is adapted to cool the LNG in the supply conduit 54 to 90.5K. This requires a liquid nitrogen temperature of approximately 77K or lower in the cooling section 60.

The LNG from the supply 52 travels through the supply conduit 54 and is cooled by the precooling section 62 and the cooling section 60. The cooling section 60 cools the methane sufficiently so as to solidify the LNG on the belt 56. The solidified LNG forms a sheet of natural gas, which travels along the belt 56 to an auger 66 or other suitable conveyor. The auger extends from a tail section of the belt 56 to the first vessel 10 and is driven by a motor 68, for example. The sheet of natural gas breaks at the tail section or other bend of the belt 56 to form chips or flakes, which are conveyed by the auger 66 to the first vessel 10. The chips or flakes rest near the bottom of the vessel 10 and may mix with LNG in the vessel to form a slush.

The solid natural gas is preferably supplied at a temperature at or near its melting point. Thus, diluents or components of the recovered fugitive gasses having lower boiling points than the melting point of methane, such as oxygen and nitrogen, will remain gaseous. These components can be vented or otherwise separated and recovered from the vessel 10. Components having a higher melting point, such as carbon dioxide, will solidify and settle at the bottom of the vessel for subsequent removal.

In the manner described, fugitive methane or natural gas can be recovered and reliquified for use simply and efficiently. Methane that would otherwise escape to the environment and be lost can be used and the supply of methane is not contaminated.

The present disclosure describes several embodiments of the invention, however, the invention is not limited to these embodiments. Other variations are contemplated to be within the spirit and scope of the invention and appended claims.

What is claimed is:

1. A method of condensing fugitive methane, comprising the steps of:

manufacturing solid methane; and passing fugitive methane in heat exchange relationship with the solid methane so as to condense the fugitive methane, the step of manufacturing the solid methane including providing liquid methane; cooling the liquid methane to form a sheet of solid methane; and breaking the sheet into pieces.

2. A method according to claim 1, wherein the sheet is formed on a moving endless belt and the sheet is broken at a bend in the belt.

3. A method according to claim 1, wherein the step of cooling the liquid methane includes cooling with a refrigeration system using liquid nitrogen as a refrigerant.

4. An apparatus for condensing fugitive methane, comprising:

a first vessel for containing liquid methane;

a delivery conduit for conveying liquid methane from the first vessel to a second vessel;

a recovery apparatus for recovering fugitive methane vapors produced from evaporation of liquid methane;

a recovery conduit for transferring fugitive methane from the recovery apparatus to the first vessel; and a device in communication with the recovery conduit arranged to convey the fugitive methane vapors into thermal communication with solid methane, said fugitive methane vapors being condensed by a transfer of heat to the solid methane.

5. An apparatus according to claim 4, wherein the solid methane is mixed with liquid methane to form a slush.

6. An apparatus according to claim 4, wherein said device includes a sparger in communication with the recovery conduit and located in the first vessel so as to convey the fugitive methane vapors through interstices of solid methane in the first vessel, said fugitive methane vapors being condensed by the solid methane.

7. An apparatus according to claim 4, further comprising a solid methane manufacturing system for manufacturing and conveying solid methane to the first vessel.

8. An apparatus according to claim 7, wherein the solid methane manufacturing system comprises:

a supply conduit in communication with the first vessel and connectable to a source of fluid methane; and a cooler in heat exchange relationship with the supply conduit adapted to solidify fluid methane from the source, said solidified methane being conveyed to the first vessel by the supply conduit.

9. An apparatus according to claim 8, wherein the source of fluid methane is the first vessel.

10. An apparatus according to claim 8, wherein the cooler includes a cooling coil circulating coolant.

11. An apparatus according to claim 8, further comprising a surface disposed in the supply conduit on which a sheet of solid methane can be formed.

12. An apparatus according to claim 11, further comprising means for breaking the sheet of solid methane.

13. An apparatus according to claim 7, wherein the solid methane manufacturing system comprises:

a supply conduit having upper, middle, and lower sections in communication with the first vessel and connectable to a source of liquid methane;

an endless belt disposed in the supply conduit;

a cooling coil in counterflow, heat exchange relationship with the supply conduit and circulating a coolant, the cooling coil having a subcooling section at the lower section, a cooling section at the middle section, and a precooling section at the upper section, so as to solidify liquid methane from the source on the belt; and an auger disposed in the lower section of the supply conduit for conveying said solidified methane from the belt to the first vessel.

14. An apparatus according to claim 13, wherein the endless belt is adapted to break the sheet into pieces and the auger is adapted to convey such pieces.

* * * * *